United States Patent [19]

Fukui

[11] 4,011,784

[45] Mar. 15, 1977

[54] TRANSPOSITION APPARATUS FOR AN ELECTRONIC MUSICAL INSTRUMENT

[75] Inventor: Tutomu Fukui, Tokyo, Japan

[73] Assignee: Pioneer Electronic Corporation, Tokyo, Japan

[22] Filed: Feb. 24, 1975

[21] Appl. No.: 552,086

Related U.S. Application Data

[63] Continuation of Ser. No. 420,501, Nov. 30, 1973, abandoned.

[30] Foreign Application Priority Data

Dec. 19, 1972 Japan ..... 47-127395

[52] U.S. Cl. ..... 84/1.01; 84/1.03; 84/1.24; 84/1.17

[51] Int. Cl.[2] ..... G10H 1/00

[58] Field of Search ..... 84/1.01, 1.03, 1.24, 84/1.17, 445, 462, 1.19; 307/221 R; 328/37; 179/15 AQ

[56] References Cited

UNITED STATES PATENTS

| | | | |
|---|---|---|---|
| 3,601,518 | 8/1971 | Hill | 84/1.01 |
| 3,610,800 | 10/1971 | Deutsch | 84/1.01 |
| 3,674,907 | 7/1972 | Derry | 84/1.01 |
| 3,697,661 | 10/1972 | Deutsch | 84/1.01 |
| 3,746,773 | 7/1973 | Uetrecht | 84/1.01 |
| 3,868,882 | 3/1975 | Fukui et al. | 84/462 |

*Primary Examiner*—Ulysses Weldon
*Attorney, Agent, or Firm*—Sughrue, Rothwell, Mion, Zinn & Macpeak

[57] ABSTRACT

A transposition apparatus for an electronic musical instrument such as an electronic organ is disclosed. The transposition apparatus permits the playing of a musical score in any desired key regardless of the key actually being played. The apparatus converts the actual keying pattern to a serial bit pattern which is then delayed by a desired number of bit positions. The delayed serial bit pattern is then converted back to a keying pattern to actuate the tone generator of the instrument.

2 Claims, 2 Drawing Figures

TRANSPOSITION APPARATUS FOR AN ELECTRONIC MUSICAL INSTRUMENT

This is a continuation of application Ser. No. 420,501, filed Nov. 30, 1973, now abandoned.

BACKGROUND OF THE INVENTION

1. Field of the Invention

This invention relates to a transposition apparatus for an electronic musical instrument such as an electronic organ whereby a musical performance in a desired key can be effected regardless of the key actually being played.

2. Description of the Prior Art

When performing on an electronic muscial instrument, it is sometimes necessary to select a key harmonous with other musical instruments or voices, but is is difficult to play the musical instrument in accordance with the desired key when a score is written in a key different from the key to be performed. One solution to this problem has been an electronic organ having a variable-frequency master oscillator. This makes the musical performance in the desired key possible regardless of the key actually played. However, this solution results in instability owing to making a generating frequency thereof variable, and further it is attended with a defect such that it is impossible to transpose instantly without modifying a musical interval.

SUMMARY OF THE INVENTION

The primary object of the present invention is to provide a transposition apparatus capable of effecting a desired transposition instantly, keeping a good musical interval.

The foregoing and other objects of the invention are attained by providing in an electronic organ, for example, a parallel to serial converter to convert the actual keying pattern to a serial bit pattern. This serial bit pattern is then delayed a desired number of bit positions by a bit-delay circuit. A serial to parallel converter then converts the output of the bit-delay circuit to a parallel keying pattern which is used to actuate the tone generator of the organ.

BRIEF DESCRIPTION OF THE DRAWINGS

The specific nature of the invention, as well as other objects, aspects, uses, and advantages thereof, will clearly appear from the following description and from the accompanying drawings, in which.

DESCRIPTION OF PREFERRED EMBODIMENT

Figure 1:
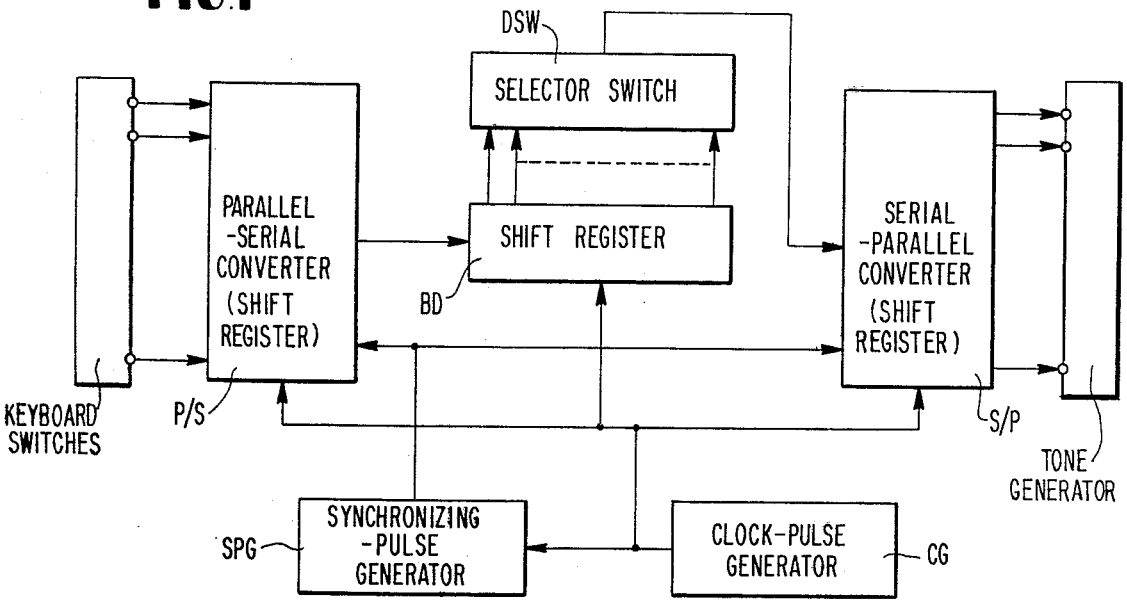
FIG. 1 is a block-diagram showing a transposition apparatus in accordance with the present invention.
Figure 2:
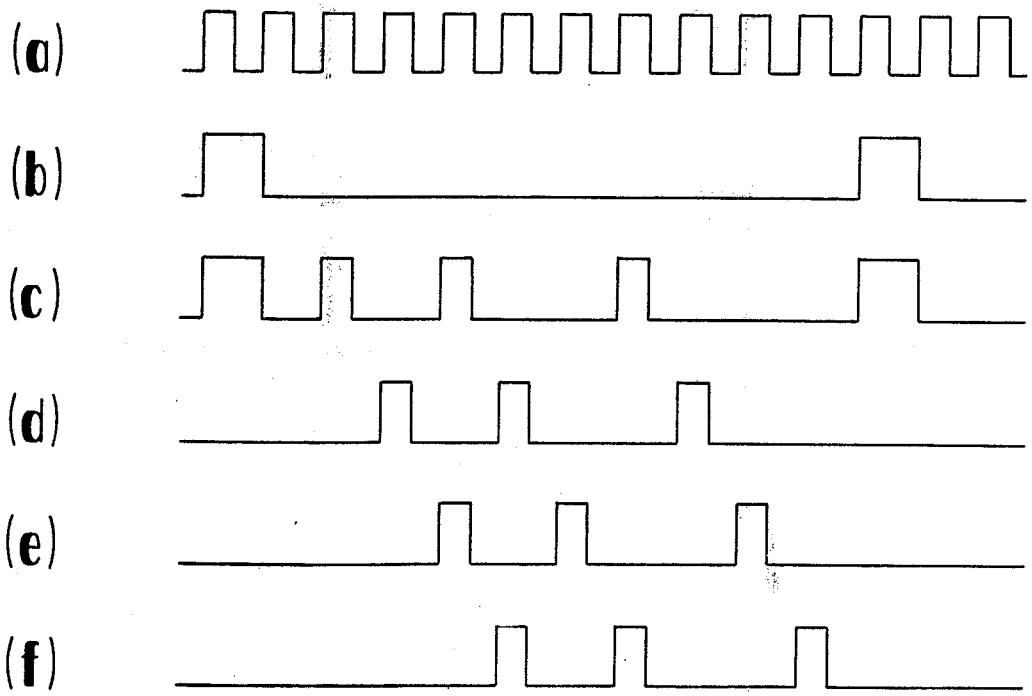
FIG. 2 is a chart showing waveforms in several points of the same apparatus.

The preferred embodiment of the present invention will be described with reference to the drawings. The symbol P/S represents a parallel-in, serial-out converter, which may be, for example, a shift register. Such a shift register is shown, for example, in FIG. 3 of copending application Ser. No. 417,331, now U.S. Pat. No. 3,868,882, filed Nov. 19, 1973, for "Automatic Musical Performance Method and Apparatus for a Keyed Instrument", by Tutomu Fukui et al, now U.S. Pat. No. 3,868,882. This converter P/S has as many input terminals as switches which turn on and off in accordance with the movement of keys of an electronic musical instrument, such as an electronic organ. When the switches are closed, signals are applied to the input terminals corresponding with the closed switches. More specifically, the pattern of the input terminals to which signals are applied corresponds with a keying pattern obtained by playing an electronic organ. The parallel-serial converter P/S scans the parallel signal pattern in response to and at the frequency of clock-pulses applied from a clock-pulse generator CG and generates a serial pulse signals wherein pulses occur only at bit positions corresponding to the touched keys. A synchronizing pulse generated by a synchronizing-pulse generator SPG resets the parallel-serial converter at the beginning of each scanning period. A waveform of the clock-pulse from the clock-pulse generator CG is shown in FIG. 2*a*, a waveform of the synchronizing pulse from the synchronizing-pulse generator SPG is shown in FIG. 2*b*, and a waveform (in this example, some three keys are touched) of the serial pulse signal from the parallel-serial converter P/S is shown in FIG. 2*c*, respectively.

One of the conditions of the present embodiment is that the shift register which constitutes the parallel-serial converter P/S has a number of additional stages more than the number of input terminals. The additional stages would be equal to the number or kinds of desired transpositions and serve to prevent signals for low-pitch tones from being shifted as signals for high-pitch tones. The synchronizing-pulse generator, which may be a counter, generates a synchronizing-pulse with a periodicity equal to one bit time period more than the number of bits in the parallel-serial converter shift register.

The serial pulse signals sent out of the parallel-serial converter P/S is applied to the next shift register BD. An output terminal of each stage of the shift register BD is connected to a corresponding input terminal of a multi-position selector switch DSW. Thus, the serial pulse signals progressively delayed by one bit appears at the input terminals of the switch DSW. This is shown in FIGS. 2*d*, 2*e* and 2*f*, for example.

The switch DSW has the function of being able to select a relative one of its input terminals corresponding to an output terminal of the shift register BD. Depending on the position of the switch DSW this has the effect of shifting either to the left or right a base bit of the shift register BD from which one block of bits between adjacent synchronizing pulses is reckoned. As an example, in a case where the base bit is shifted by one bit position, a serial pulse signal as shown in FIG. 2*e* is obtained for an output of the switch DSW, and in a case where the base bit is shifted by two bit positions, a serial pulse signal as shown in FIG. 2*f* is obtained as an output thereof.

The output of the switch DSW is applied to a serial-parallel converter S/P which, again, may be a shift register controlled by the clock-pulse generator and reset by the synchronizing-pulse generator. Such a shift register is shown, for example, in FIG. 6 of the aforementioned copending application Ser. No. 417,331. The outputs that appear at the output terminals of serial-parallel converter S/P are in positions corresponding to the original keying pattern but transposed. These output terminals are connected with input terminals of the tone generator of the electronic music instrument, and tone signals of the musical scale for the touched keys are generated there. In a case that the base bit of the switch DSW agrees with the base bit of the shift register BD, the original tone signals of touched keys are generated, and in a case that the base bit is shifted by one bit toward a high-pitch tone, a tone signal of C# is emitted when the key of C, for example, is touched. Namely, the emitted tone signal is transposed by a chromatic interval toward a high-pitch tone. Consequently, by setting the base bit of the switch DSW at any desired position thereof, a musical performance of a desired key can be effected although key positions are fixed, and thus either a concert or an accompaniment may be played extremely easily.

In the present embodiment, the transposition is effected by means of shifting the base bit of the switch DSW, but the same operation or function may also be effected by means of delaying the synchronizing pulse signal by the number of bits necessary for the desired transposition. Further, the transposition may be carried out by omitting some bits from the clock-pulse signal applied to the serial-parallel converter S/P during each scanning period.

It will be apparent, then, that the embodiment shown is only exemplary and that various modifications can be made in construction and arrangement within the scope of the invention as defined in the appended claims.

I claim:

1. A transposition apparatus for an electronic musical instrument having a plurality of keyboard switches comprising:

a. first shift register having a plurality of stages equal to the number of keyboard switches plus a number of additional stages equal to the number of desired transpositions, each of said switches being connected to the input of a corresponding first shift register stage, said first shift register converting the parallel keying pattern represented by switches actuated by keys on said musical instrument to a serial pulse signal where the bit positions of the pulses in said signal correspond to said actuated switches, said additional stages serving to prevent signals for low-pitch tones from being shifted as signals for high-pitch tones, b. delay means connected to receive said serial pulse signal for delaying the signal by a predetermined number of bit positions, c. second shift register connected to receive the delayed serial pulse signal for converting the received signal to a parallel keying pattern transposed from said original keying pattern, said transposed keying pattern being used to control the tone generator in the musical instrument, d. a clock-pulse generator connected to both of said first and second shift registers to shift bits out of said first shift register and to shift bits into said second shift register, and e. a synchronizing-pulse generator connected to receive clock pulses from said clock-pulse generator and periodically producing a synchronizing pulse to reset both of said first and second shift registers.

2. A transposition apparatus as recited in claim 1 wherein said delay means comprises:

a. a third shift register having a plurality of outputs and connected to receive the serial output signal from said first shift register under the control of said clock-pulse generator, and b. a multi-position selector switch connected to select as an output to said second shift register any one of the outputs from said third shift register.

* * * * *